US010290453B2

(12) United States Patent
Trandal et al.

(10) Patent No.: US 10,290,453 B2
(45) Date of Patent: May 14, 2019

(54) ACTUATOR OVERRIDE MECHANISM FOR SUBSEA CIRCUIT BREAKER

(71) Applicant: ABB Schweiz AG, Baden (CH)

(72) Inventors: Arne Trandal, Sandsli (NO); Paul Midtun, Bergen (NO); Svein-Ove Urnes, Knarrevik (NO)

(73) Assignee: ABB Schweiz AG, Baden (CH)

( * ) Notice: Subject to any disclaimer, the term of this patent is extended or adjusted under 35 U.S.C. 154(b) by 78 days.

(21) Appl. No.: 15/169,009

(22) Filed: May 31, 2016

(65) Prior Publication Data

US 2016/0358735 A1 Dec. 8, 2016

(30) Foreign Application Priority Data

Jun. 5, 2015 (EP) ..... 15170751

(51) Int. Cl.

| | |
|---|---|
| ***H01H 71/24*** | (2006.01) |
| ***H01H 3/56*** | (2006.01) |
| ***H01H 33/53*** | (2006.01) |
| ***H01H 9/04*** | (2006.01) |

(52) U.S. Cl.

CPC ..... *H01H 71/24* (2013.01); *H01H 3/56* (2013.01); *H01H 9/04* (2013.01); *H01H 33/53* (2013.01)

(58) Field of Classification Search

CPC ..... H01H 71/24; H01H 9/04; H01H 33/53; H01H 3/56; H02B 13/00

See application file for complete search history.

(56) References Cited

U.S. PATENT DOCUMENTS

| | | | | |
|---|---|---|---|---|
| 4,647,733 | A | 3/1987 | Rose | |
| 6,762,662 | B2 | 7/2004 | Lee et al. | |
| 8,263,893 | B2 * | 9/2012 | Ronhovd | E21B 33/0355 218/120 |
| 8,749,327 | B2 * | 6/2014 | Harmon | H01H 71/40 335/13 |
| 9,276,387 | B2 * | 3/2016 | Mills | H01H 9/04 |
| 2003/0090352 | A1 | 5/2003 | Lee et al. | |
| 2006/0131143 | A1 * | 6/2006 | Eriksson | H01H 33/68 200/48 R |
| 2011/0109411 | A1 | 5/2011 | Lee | |
| 2014/0062623 | A1 * | 3/2014 | Fasano | H01H 71/2463 335/16 |
| 2017/0213673 | A1 * | 7/2017 | Elshani | H01H 33/56 |

FOREIGN PATENT DOCUMENTS

| | | | |
|---|---|---|---|
| CN | 201238003 | Y | 5/2009 |
| GB | 2206240 | A | 12/1988 |
| GB | 2463487 | A | 3/2010 |

OTHER PUBLICATIONS

European Search Report Application No. 15170751.0 Completed: Nov. 26, 2015; dated Dec. 7, 2015 5 pages.

* cited by examiner

*Primary Examiner* — Bernard Rojas

(74) *Attorney, Agent, or Firm* — Whitmyer IP Group LLC

(57) ABSTRACT

A subsea circuit breaker for a subsea power distribution system. The subsea circuit breaker includes a circuit breaker enclosure, first and second contacts and an electro-mechanical actuator. The subsea circuit breaker is also furnished with a mechanical transmission mechanism for opening or closing the contacts in response to a mechanical command operation from the outside of the circuit breaker enclosure.

15 Claims, 2 Drawing Sheets

ACTUATOR OVERRIDE MECHANISM FOR SUBSEA CIRCUIT BREAKER

TECHNICAL FIELD

The present disclosure generally pertains to subsea power distribution systems and in particular to a subsea circuit breaker for a subsea power distribution system.

In this disclosure the term "subsea" is intended to specify a region close to the seabed at great depths, at least 1000 m. Such a region can also be defined as "deepwater subsea".

BACKGROUND

In recent years, there has been a growing interest in electrical installations on the seabed. In bringing power electronics subsea, two general concepts exist: (1) the equipment stays at atmospheric pressure; and (2) the equipment is pressurized to the hydrostatic pressure level on seabed.

Concept (1) has the advantage that standard electric/electronic components, known from onshore installations, can be used, while disadvantages include thick walls needed for the enclosure to withstand the pressure difference between inside and outside. Thick walls make the equipment heavy and costly and in addition prevent efficient cooling of the internal electric/electronic components. Also, the pressure difference sets high requirements on seals and penetrators.

Concept (2) has the advantage that no thick walls are needed for the enclosure since no or only a relatively small pressure difference exists between inside and outside. Disadvantages are that the electric/electronic components must be able to cope with the prevailing pressure, and that reliable pressure compensation must be provided for.

In electrical power transmission and distribution, a circuit breaker can be defined as a fault triggered electrical switch with the purpose of protecting electrical consumers and cables from abnormal situations such as short circuit or overload. The switch comprises two contacts which are brought to engagement or disengagement by an actuator. The actuator is typically electro-mechanical. A control means is arranged to detect abnormal situations, or faults, and in response thereto send a signal to the actuator which then separates the contacts whereby power is cut off.

In addition to being fault triggered, a circuit breaker can usually also be command controlled. The above mentioned control means then receives a command from an operator or from a control system and in response thereto sends a signal to the actuator which opens or closes the switch.

Traditionally when circuit breakers are used in subsea power distribution systems, a circuit breaker is placed inside a closed enclosure together with its electro-mechanical actuator. GB2463487 A discloses a subsea electrical protection device which comprises a re-settable circuit breaker. U.S. Pat. No. 6,762,662 B2 discloses a hermetically sealed electrical switch comprising magnetic force transfer means. The hermetically sealed electrical switch of U.S. Pat. No. 6,762,662 B2 is however not suitable for subsea use, especially not for "deepwater subsea" due to the prevailing pressure at great depths, at least 1000 m.

SUMMARY

In order to open and/or close a circuit breaker of the type described above needs electrical power in some form. A circuit breaker placed together with its actuator inside a closed enclosure at the seabed is vulnerable to loss of electrical power to the actuator or failure in the electro-mechanical actuator itself. Also, the circuit breaker is not maneuverable during start-up when the subsea power distribution system is de-energized.

A general object of the present invention is to enhance the capability of the traditional subsea circuit breaker and thus the subsea power distribution system to meet the above problems.

According to the present invention this object is solved by a subsea circuit breaker for a subsea power distribution system, which subsea circuit breaker comprises a water tight circuit breaker enclosure within which are arranged first and second contacts and an electro-mechanical actuator. The electro-mechanical actuator is adapted to open the contacts in response to a fault signal and to open or close the contacts in response to a command signal. The subsea circuit breaker further comprises a protection element arranged within the circuit breaker enclosure and adapted to generate said fault signal. Also within said circuit breaker enclosure is a command signal input interface for receiving said command signal. Importantly, a mechanical transmission means is provided within the circuit breaker enclosure for causing the contacts to open or close in response to a mechanical command operation from the outside of the circuit breaker enclosure.

By means of the mechanical transmission means, the contacts can be opened or closed by a mechanical command operation, even if the subsea circuit breaker is not supplied with electrical power. This is especially beneficial during a so called Black start, which can be defined as a situation when the main power is off and there is no power available in any UPS (Uninterruptible Power Supply). Also by means of said mechanical transmission means, the contacts can be maneuvered in the event of failure in the electromechanical actuator. In other words, the capability of a traditional subsea circuit breaker and thus the subsea power distribution system is enhanced by the introduction of a mechanical override functionality, provided by the mechanical transmission means.

The subsea circuit breaker may comprise a magnetic force transfer means adapted to transfer a mechanical force of said mechanical command operation to said mechanical transmission means. Said force can thus be transferred to the mechanical transmission means without breaching the water barrier of the circuit breaker enclosure. Said force may for example be a translative force or a rotative force. The magnetic force transfer means is preferably adapted to transfer a torque of said mechanical command operation to said mechanical transmission means. Since the magnetic force transfer means will slip at a predefined force, the mechanical transmission means and any internal components to which it is mechanically connected will be protected from high forces.

If the magnetic force transfer means is adapted to transfer a rotative force and the rotative force that the magnetic force transfer means is able to transfer without slipping is too low, a mechanical gear can be arranged within the subsea circuit breaker in order to change said rotative force up.

The magnetic force transfer means may comprises outer magnetic means arranged outside the circuit breaker enclosure and inner magnetic means arranged inside the circuit breaker enclosure. Alternatively, the outer magnetic means is comprised in the subsea circuit breaker but brought to the subsea circuit breaker when the contacts are to be opened or closed.

Preferably, at least one of said outer and inner magnet means comprises a permanent magnet. The outer magnetic means may comprise a permanent magnet and the inner magnetic means may comprise a material which is attracted to permanent magnets, such as the metal iron. Preferably, in order to obtain an effective magnetic force transfer means, both the outer and the inner magnet means comprise a permanent magnet.

Since the circuit breaker enclosure may comprise a material which hinders the magnetic interaction between the outer and inner magnet means, a magnetic transfer area may be arranged in-between the outer and inner magnetic means. More in detail, the magnetic transfer area would be arranged to replace the material of the circuit breaker enclosure in the area of the outer and inner magnetic means. The magnetic transfer area would exhibit a low relative magnetic permeability so that it essentially does not affect the magnetic interaction of the outer and inner magnetic means. The relative magnetic permeability ($\mu/\mu_0$) of the magnetic transfer area is preferably lower than 2.

As has been described, the magnetic force transfer means is preferably adapted to transfer a torque and at least one of said outer and inner magnet means comprises a permanent magnet. The torque can be transferred by the outer and inner magnet means being arranged at a distance from a common axis, and being arranged to rotate around said axis.

The subsea circuit breaker may comprise a mechanical operation input interface for receiving said mechanical command operation. Said mechanical operation input interface can be accessed locally at the subsea-deployed circuit breaker. The mechanical operation input interface is connected to the mechanical transmission means via the magnetic force transfer means. The operation input interface may be a turning device such as a handle, a valve wheel, a tool receiving recess, or a remotely operated vehicle interface. Should the mechanical force of said mechanical command operation be a translative force, the mechanical operation input interface may be a slider or a sliding mechanism.

The mechanical transmission means is preferably mechanically connected to the electro-mechanical actuator, such that a mechanical command operation from the outside of the circuit breaker enclosure moves the mechanical transmission means which in turn moves the electro-mechanical actuator such that the contacts open or close.

As an alternative, the subsea circuit breaker may comprise a mechanical actuator which is separate from the electro-mechanical actuator and the mechanical transmission means may be mechanically connected to said mechanical actuator. The mechanical actuator, rather than the electro-mechanical actuator, is then adapted to open or close the contacts in response to a mechanical command operation from the outside of the circuit breaker enclosure.

The electro-mechanical actuator, or the mechanical actuator, mentioned above may comprise two end positions. A first end position in which the contacts are open and a second end position in which the contacts are closed. The electro-mechanical actuator or the mechanical actuator may then be brought to the first end position by the mechanical transmission means, and the operator will know that the contacts are open. This may for instance be achieved by a diver turning the above mentioned turning device clockwise a certain angle or a certain number of turns.

The circuit breaker enclosure may be pressure resistant and thereby adapted to ensure that the pressure inside the circuit breaker enclosure essentially equals atmospheric pressure irrespective of the outer pressure. This brings the advantage that standard electric/electronic components can be used in the subsea circuit breaker. Penetrators through the circuit breaker enclosure should be avoided as far as possible due to the pressure difference, which makes the above mentioned magnetic force transfer means particularly beneficial.

Alternatively, the subsea circuit breaker may be pressure compensated. The circuit breaker enclosure is then filled with a dielectric liquid and the subsea circuit breaker furnished with a pressure compensating device. The pressure compensating device is adapted to ensure that the pressure inside the circuit breaker enclosure essentially equals the pressure outside the circuit breaker enclosure. Such a pressure compensating device may comprise a flexible membrane or a bellows separating the dielectric liquid and the sea water. Such a pressure compensating device may be referred to as a passive pressure compensating device.

According to the present invention the above object is also solved by a subsea unit, such as a subsea switchgear, for a subsea power distribution system with a subsea circuit breaker of the type described. The subsea unit comprises a water tight subsea unit enclosure which encloses said subsea circuit breaker, and the above mentioned circuit breaker enclosure forms a part of the subsea unit enclosure.

Finally, the object is also solved by a subsea power distribution system comprising a subsea circuit breaker of the type described and/or the above subsea unit.

BRIEF DESCRIPTION OF THE DRAWINGS

Specific embodiments of the invention will now be described, by way of example, with reference to the accompanying drawings, in which.

DETAILED DESCRIPTION

Figure 2:
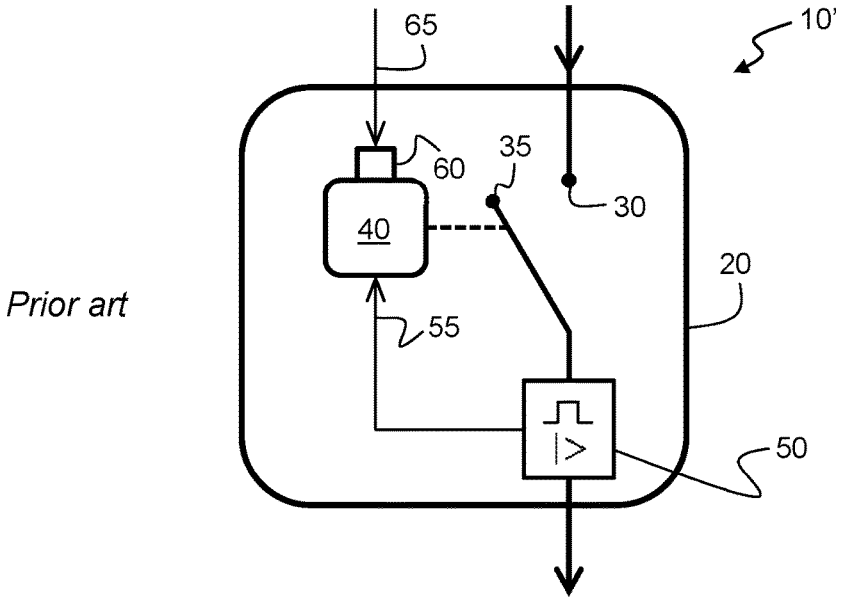
Prior art Fig 2
FIG. 2 is a schematic side view of a subsea circuit breaker according to prior art.

FIG. 2 discloses a prior art subsea circuit breaker 10'. The subsea circuit breaker 10' comprises a water tight circuit breaker enclosure 20 and two contacts 30, 35. The first contact 30 is stationary and is connected to an ingoing power line. The second contact 35 is movable and is connected to an outgoing power line. The ingoing power line is typically connected to a land based power grid (not illustrated), and the outgoing power line supplies one or more subsea electrical power consumers (item 210 in FIG. 4), such as a subsea power converter, with electricity.

The movable contact 35 is maneuvered/actuated by an electro-mechanical actuator 40 positioned within the circuit breaker enclosure 20, as is schematically illustrated by a dashed line between the electro-mechanical actuator 40 and the movable contact 35 arm.

A protection element 50 is arranged to measure the current and/or the voltage on the outgoing power line. The protection element 50 is capable of detecting faults such as short circuits or overload situations on the outgoing power line. As is shown, the protection element 50 is coupled to the electro-mechanical actuator 40.

During operation, i.e. when the contacts 30, 35 are closed and electrical power passes through the subsea circuit breaker 10', the protection element 50 monitors the outgoing power line. In the event of a fault, the protection element 50 generates a fault signal 55 which is sent to the electro-mechanical actuator 40. Upon receipt of a fault signal 55, the electro-mechanical actuator 40 quickly opens the contacts 30, 35 by moving the movable contact 35 to the open position (the position which is illustrated in the figures). In this way, the outgoing electrical power is shut off and the connected electrical equipment, such as subsea electrical power consumers and cables, are protected from damage.

The electro-mechanical actuator 40 is not only capable of maneuvering the movable contact 35 upon receipt of a fault signal 55, but also in response to a command signal 65. Such a command signal 65 is typically generated by a top-side control system (not shown). The command signal 65 is received by a command signal input interface 60 arranged within the circuit breaker enclosure 20. In the present disclosure, the command signal input interface 60 is formed by an input port 60 on the electro-mechanical actuator 40.

Figure 1:
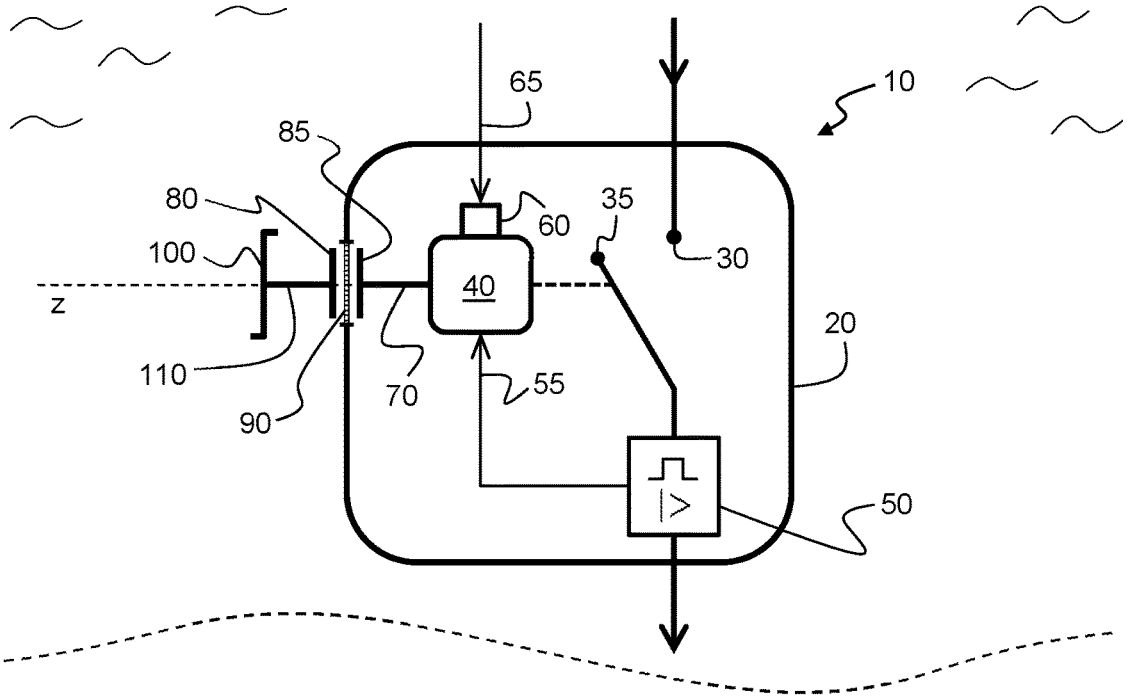
FIGS. 1 and 3 are schematic side views of embodiments of subsea circuit breakers.

Turning now to the present invention, a first embodiment is shown in FIG. 1 which schematically discloses a subsea circuit breaker 10 installed underwater close to the seabed. All that has been explained above with reference to the prior art subsea circuit breaker 10' of FIG. 2 applies to FIG. 1 as well. The same reference numerals have therefore been used for the components of the prior art subsea circuit breaker 10' as for the components of the subsea circuit breaker 10 of the invention.

In FIG. 1, the water is schematically illustrated by short wavy lines on the top left and right sides of the subsea circuit breaker 10, and the seabed is illustrated by a dashed wavy line below the subsea circuit breaker 10. The subsea circuit breaker 10 is submerged underwater and thereby completely surrounded by water and rests on the seabed. Even though not shown in the schematic figures of the present disclosure, the subsea circuit breaker 10 (or the subsea unit 200 of FIG. 4) is typically installed on subsea foundations or support structures.

On the left hand side of the subsea circuit breaker 10 in FIG. 1, a so called mechanical override mechanism is illustrated. By means of this mechanism, the contacts 30, 35 can be maneuvered manually from the outside of the subsea circuit breaker 10.

The components of the present exemplifying embodiment of the mechanical override mechanism will now be described in detail. As is shown, a mechanical transmission means 70 in the form of an inner shaft 70 exits the electro-mechanical actuator 40. If this inner shaft 70 is rotated, the electro-mechanical actuator 40 maneuvers the movable contact 35 without using any electrical power. In this connection, it is pointed out that the contacts 30, 35 and the electro-mechanical actuator 40 are illustrated very schematically. The movable contact 35 may engage and disengage the stationary contact 30 while performing a pivoting movement (as illustrated), a rotating movement (not illustrated), or a linear movement (not illustrated). The movable and stationary contacts 30, 35 may also swap place such that the second contact 35 is connected to the ingoing power line.

In the present embodiment, a contact free method of transferring torque from the outside of the circuit breaker enclosure 20 to the inside of the circuit breaker enclosure 20 is put to use. A magnetic force transfer means is arranged to transfer a mechanical force through the circuit breaker enclosure 20. The inner shaft 70 ends at an inner magnetic means 85. On the outside of the circuit breaker enclosure 20, an outer magnetic means 80 is arranged facing the inner magnetic means 85. Even though not shown here, the subsea circuit breaker 10 can comprise a casing or similar which rotatively supports outer magnetic means 80. Alternatively, the outer magnetic means 80 may not be comprised in the subsea circuit breaker 10, but may be an external element. The outer magnetic means 80 may form part of a separate "key" which can be brought to the subsea circuit breaker 10 in order to open or close the contacts.

A magnetic transfer area 90 is located between the inner and outer magnetic means. The magnetic transfer area 90 is a part of the circuit breaker enclosure 20, and the purpose of the magnetic transfer area 90 is to ensure that the inner and outer magnetic means may cooperate without the circuit breaker enclosure 20 obstructing the magnetic interaction. The circuit breaker enclosure 20, apart from the magnetic transfer area 90, may be of a material which does not allow magnetic interaction through it such as a material which is attracted to permanent magnets.

Suitable materials for the magnetic transfer area are especially aluminium ("aluminum" in US English), glass, copper, platinum and austenitic stainless steel. These materials have a relative magnetic permeability which is very close to 1 (the relative magnetic permeability of vacuum), which means that the materials have little effect on a magnetic field passing through them. In this disclosure, a relative magnetic permeability lower than 2 is defined as a low relative magnetic permeability.

The outer magnetic means 80 is connected to a mechanical operation input interface 100 which is here illustrated as a handle 100 which is maneuverable for a diver. An optional outer shaft 110 is arranged between the mechanical operation input interface 100 and the outer magnetic means 80. The mechanical operation input interface 100 may be another kind of turning device 100 such as a valve wheel. Alternatively, the mechanical operation input interface 100 may be tool receiving recess. The mechanical operation input interface 100 may be maneuverable for a diver, with or without tools. The mechanical operation input interface 100 may be a remotely operated vehicle (ROV) interface.

Thus, a diver or a ROV may operate the subsea circuit breaker 10 by turning the mechanical operation input interface 100 and thereby open or close the contacts 30, 35. In detail, the turning movement applied to the mechanical operation input interface 100 rotates the outer shaft 110 and the outer magnetic means 80. The magnetic interaction between the outer magnetic means 80 and the inner magnetic means 85 causes the inner magnetic means 85 to rotate in synchronisation with the outer magnetic means 80. Then, the inner shaft 70 brings the turning movement to the electro-mechanical actuator 40 which in turn maneuvers the movable contact 35.

The company Büchi AG Uster provides stirrer drives for use with pressure reactors or stirred autoclaves in the chemical and pharmaceutical industry. Such stirrer drives must be tight and are therefore provided with magnetic couplings. One product called "bmd 1200" is able to transfer a torque of 12 Nm and can withstand a pressure difference of 350 bar.

The product "bmd 1200" may be put to use as the magnetic force transfer means of the present disclosure. Alternatively, a similar product, "bmd 5400" which is able to transfer a higher torque of 54 Nm but withstands a lower pressure difference of 200 bar, may be put to use.

It is pointed out that the suggested stirrer drives are optimised to transfer great rotary speeds, exceeding 1000 rpm. Bering in mind that the present invention does not require transfer of torque at such great speeds, the stirrer drives could be modified to be able to transfer greater torques, but at lower rotational speeds. The modification or optimisation of the stirrer drives, enabling them to transfer higher torques which may be desired when used as magnetic force transfer means driving a circuit breaker in a subsea unit, is not the subject of the present disclosure.

Figure 3:
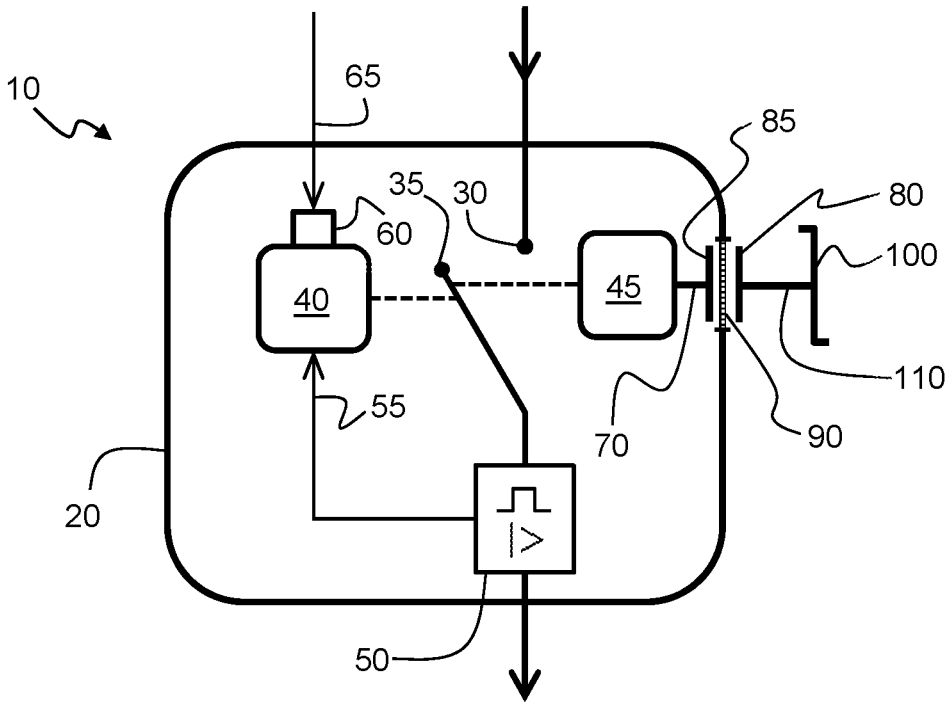

A second embodiment of the subsea circuit breaker 10 is illustrated in FIG. 3. This differs from the embodiment of FIG. 1 in that a purely mechanical actuator 45 has been added. Thus, subsea circuit breaker 10 comprises both an electro-mechanical actuator 40 and a mechanical actuator 45. As can be seen, the mechanical override mechanism is here realised without affecting the electro-mechanical actuator 40. The inner shaft 70 is connected to the mechanical actuator 45 and not to the electro-mechanical actuator 40. The movable contact 35 can be controlled by both the electro-mechanical actuator 40 and the mechanical actuator 45, as is illustrated by dashed lines between the movable contact 35 arm and both the electro-mechanical actuator 40 and the mechanical actuator 45, respectively.

The mechanical override mechanism of FIG. 3 functions in the same manner as the one described with reference to FIG. 1. The difference is only that the inner shaft 70 brings the turning movement to the mechanical actuator 45 (and not to the electro-mechanical actuator 40) which in turn maneuvers the movable contact 35. The same reference numerals have therefore been used in FIGS. 1 and 3, apart from the reference numeral of the added mechanical actuator 45.

In the embodiments shown here, the magnetic force transfer means is adapted to transfer a rotative force. In other words the magnetic force transfer means is able to transfer a rotational movement or a torque. However, the magnetic force transfer means may alternatively be adapted to transfer a translative force, e.g. a linear force, in this connection a straight movement. In order to accomplish the latter, the mechanical operation input interface may be a slider or a sliding mechanism (not shown) which is connected to the outer magnetic means 80. The inner magnetic means 85 would be adapted to travel along a straight line inside the subsea circuit breaker 10 and be arranged to open or close the contacts 30, 35 in response to a linear mechanical command operation from the outside of the circuit breaker enclosure 20.

U.S. Pat. No. 6,762,662 B2 relates to a hermetically sealed electrical switch which is not suitable for subsea use. However, the document does disclose an example of a magnetic force transfer means (items 140 and 160) which may transfer a translative force (FIG. 1), or a rotative force (items 230 and 250 in FIG. 5).

The subsea circuit breakers 10 shown in FIGS. 1 and 3 are stand-alone or self-contained devices. The subsea circuit breakers 10 may be pressure proof or pressure compensated. More in detail, the circuit breaker enclosure 20 may be pressure resistant in order to ensure that the pressure inside the circuit breaker enclosure 20 essentially equals atmospheric pressure, even when the subsea circuit breakers 10 is installed at a great depth. Alternatively, the circuit breaker enclosure 20 may be filled with a dielectric liquid and the subsea circuit breaker 10 may comprise or be connected to a pressure compensating device (not shown). Pressure compensating devices are known to the skilled person and therefore not described further here.

Figure 4:
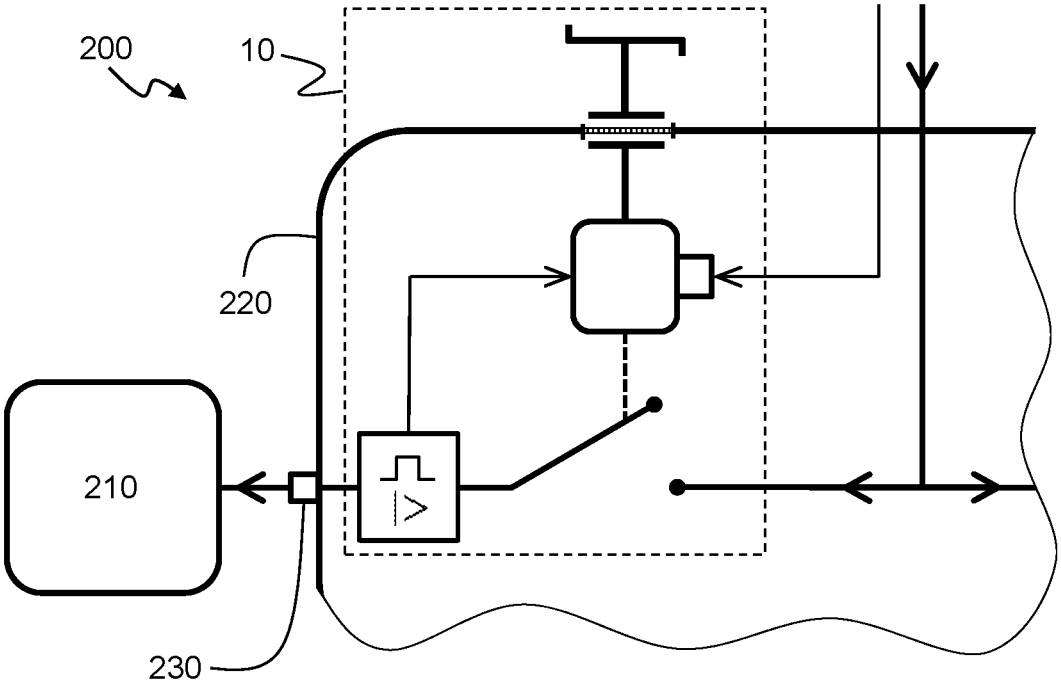
FIG. 4 is a schematic side view of a subsea unit comprising a subsea circuit breaker according to FIG. 1 and an external electrical consumer.

It is to be appreciated that a subsea circuit breaker 10 of the invention may also be incorporated as a part of a subsea unit 200. FIG. 4 schematically illustrates a subsea circuit breaker 10 as the one of FIG. 1 as a part of a subsea unit 200. In this example, the subsea circuit breaker 10 is not a stand-alone or self-contained device and does not have an enclosure of its own. Thus, the circuit breaker enclosure forms a part of the subsea unit enclosure 220. The subsea unit 200 may be pressure proof or pressure compensated.

The subsea unit 200 of FIG. 4 may comprise a plurality of subsea circuit breakers and also other internal equipment. Some of the subsea circuit breakers may comprise mechanical override mechanisms are described herein, and others not. The subsea unit 200 may be a subsea switchgear. The subsea unit 200 of FIG. 4 is connected to a subsea electrical power consumer 210. The subsea electrical power consumer 210 may be retrievable. Even in the event that the subsea unit 200 if not being supplied with electrical power, the mechanical override mechanism of the subsea circuit breaker 10 may be used to open or close the path of current to the subsea electrical power consumer 210.

The invention claimed is:

1. A subsea circuit breaker for a subsea power distribution system, the circuit breaker being configured for use underwater at depths of at least 1000 m and comprising:

a water tight circuit breaker enclosure, first and second contacts arranged within the circuit breaker enclosure, an electro-mechanical actuator arranged within the circuit breaker enclosure and adapted to open the contacts in response to a fault signal and to selectively open or close the contacts in response to a command signal, a protection element arranged within the circuit breaker enclosure and adapted to generate said fault signal, a command signal input interface arranged within the circuit breaker enclosure and adapted to receive said command signal from an external control system, wherein a mechanical transmission means is arranged within the circuit breaker enclosure and adapted to cause the contacts to selectively open or close in response to a mechanical command operation from outside of the circuit breaker enclosure, and the circuit breaker enclosure is filled with a dielectric liquid and the subsea circuit breaker comprises a pressure compensating device, the pressure compensating device is adapted to ensure that a pressure inside the circuit breaker enclosure essentially equals a pressure outside the circuit breaker enclosure.

2. The subsea circuit breaker of claim 1 comprising a magnetic force transfer means adapted to transfer a mechanical force of said mechanical command operation to said mechanical transmission means.

3. The subsea circuit breaker of claim 2, wherein the magnetic force transfer means comprises outer magnetic means, arranged outside the circuit breaker enclosure, and inner magnetic means, arranged inside the circuit breaker enclosure.

4. The subsea circuit breaker of claim 3, wherein the outer magnetic means and/or the inner magnetic means comprises a permanent magnet.

5. The subsea circuit breaker of claim 3, wherein the circuit breaker enclosure comprises a magnetic transfer area located in-between the outer and inner magnetic means, which magnetic transfer area exhibits low relative magnetic permeability, thereby essentially not affecting the magnetic interaction of the outer and inner magnetic means.

6. The subsea circuit breaker of claim 5, wherein the relative magnetic permeability ($\mu/\mu_0$) of the magnetic transfer area is lower than 2.

7. The subsea circuit breaker of claim 3, wherein the outer magnetic means comprises a permanent magnet or a material which is attracted to permanent magnets, and the inner magnetic means comprises a permanent magnet or a material which is attracted to permanent magnets, at least one of the inner and outer magnetic means comprising a permanent magnet, the permanent magnet or material which is attracted to permanent magnets of the inner and outer magnetic means being arranged at a distance from a common axis and being rotatable around said axis, such that a torque around the axis can be transferred from outside of the circuit breaker enclosure to the inside of the circuit breaker enclosure.

8. The subsea circuit breaker of claim 2 comprising a mechanical operation input interface for receiving said mechanical command operation, said mechanical operation input interface being connected to the mechanical transmission means via the magnetic force transfer means.

9. The subsea circuit breaker of claim 1, wherein the mechanical transmission means is mechanically connected to the electro-mechanical actuator.

10. The subsea circuit breaker of claim 1 comprising a mechanical actuator which is separate from the electro-mechanical actuator, the mechanical transmission means being mechanically connected to said mechanical actuator, which mechanical actuator is adapted to open or close the contacts in response to a mechanical command operation from outside of the circuit breaker enclosure.

11. The subsea circuit breaker of claim 10, wherein the electro-mechanical actuator or the mechanical actuator comprises two end positions, the first end position being one in which the contacts are open and the second end position being one in which the contacts are closed.

12. A subsea unit for a subsea power distribution system comprising:

a subsea circuit breaker configured to use underwater at depths of at least 1000 m, the subsea circuit breaker including:

a water tight circuit breaker enclosure, first and second contacts arranged within the circuit breaker enclosure, an electro-mechanical actuator arranged within the circuit breaker enclosure and adapted to open the contacts in response to a fault signal and to selectively open or close the contacts in response to a command signal, a protection element arranged within the circuit breaker enclosure and adapted to generate said fault signal, a command signal input interface arranged within the circuit breaker enclosure and adapted to receive said command signal from an external control system, wherein a mechanical transmission means arranged within the circuit breaker enclosure and adapted to cause the contacts to selectively open or close in response to a mechanical command operation from outside of the circuit breaker enclosure;

wherein the circuit breaker enclosure is filled with a dielectric liquid and the subsea circuit breaker comprises a pressure compensating device, the pressure compensating device is adapted to ensure that a pressure inside the circuit breaker enclosure essentially equals a pressure outside the circuit breaker enclosure; and a water tight subsea unit enclosure enclosing said subsea circuit breaker, the circuit breaker enclosure forming a part of the subsea unit enclosure.

13. The subsea power distribution system comprising a subsea circuit breaker and/or a subsea unit according to claim 12.

14. The subsea circuit breaker of claim 9, wherein the electro-mechanical actuator comprises two end positions, the first end position being one in which the contacts are open and the second end position being one in which the contacts are closed.

15. A subsea circuit breaker for a subsea power distribution system, the circuit breaker being configured for use underwater at depths of at least 1000 m and comprising:

a water tight circuit breaker enclosure, first and second contacts arranged within the circuit breaker enclosure, an electro-mechanical actuator arranged within the circuit breaker enclosure and adapted to open the contacts in response to a fault signal and to selectively open or close the contacts in response to a command signal, a protection element arranged within the circuit breaker enclosure and adapted to generate said fault signal, a command signal input interface arranged within the circuit breaker enclosure for receiving said command signal, wherein a mechanical transmission means is arranged within the circuit breaker enclosure and adapted to cause the contacts to selectively open or close in response to a mechanical command operation from outside of the circuit breaker enclosure, the mechanical transmission means comprising a shaft, and the circuit breaker enclosure is filled with a dielectric liquid and the subsea circuit breaker comprises a pressure compensating device, the pressure compensating device is adapted to ensure that a pressure inside the circuit breaker enclosure essentially equals a pressure outside the circuit breaker enclosure.

* * * * *